United States Patent [19]

Ito

[11] Patent Number: 4,794,304

[45] Date of Patent: Dec. 27, 1988

[54] MAGNETRON WITH COOLING FIN STRUCTURE

[75] Inventor: Takeshi Ito, Osaka, Japan

[73] Assignee: Matsushita Electronics Corporation, Kadoma, Japan

[21] Appl. No.: 945,881

[22] Filed: Dec. 24, 1986

[30] Foreign Application Priority Data

Dec. 27, 1985 [JP] Japan ..... 60-296807
Jan. 8, 1986 [JP] Japan ..... 61-1741

[51] Int. Cl.[4] ..... H01J 25/50; H01J 23/033

[52] U.S. Cl. ..... 315/39.51; 315/112; 313/24; 313/36; 313/44; 313/45; 313/17

[58] Field of Search ..... 315/39.51, 39.75, 39.67, 315/112, 39.71; 313/11, 21, 35, 44, 45, 22, 23, 24, 15, 36

[56] References Cited

U.S. PATENT DOCUMENTS 3,493,810 2/1970 Valles ..... 315/39.51
3,588,588 6/1971 Numata ..... 315/39.71 X
4,233,540 11/1980 Tashiro et al. ..... 315/39.51
4,298,825 11/1981 Daikoru et al. ..... 315/39.51
4,338,545 6/1982 Koinuma et al. ..... 315/39.71

FOREIGN PATENT DOCUMENTS 0138850 10/1981 Japan ..... 315/39.71
0165335 9/1984 Japan ..... 315/39.71

*Primary Examiner*—David K. Moore
*Assistant Examiner*—Mark R. Powell
*Attorney, Agent, or Firm*—Spencer & Frank

[57] ABSTRACT

A magnetron apparatus comprises a magnetron with an anode cylinder, and a radiator having an integral construction and attached to the outer peripheral surface of the anode cylinder so as to allow cooling air to pass therethrough. The radiator includes a plurality of horizontal plates arranged in stages and each having a cylindrical portion for receiving the anode cylinder, and a pair of vertical walls which connect adjacent ends of the horizontal plates, the vertical walls serving to maintain, between adjacent horizontal plates, a gap which is greater than the axial length of the cylindrical portion. The radiator, which has an integral construction of cooling plates; can be installed on the anode cylinder of the magnetron easily in such a manner to ensure a close contact between the radiator and the anode cylinder.

9 Claims, 4 Drawing Sheets

MAGNETRON WITH COOLING FIN STRUCTURE

BACKGROUND OF THE INVENTION

1. Field of the Invention

The present invention relates to a forced air-cooled magnetron apparatus suitable for use in microwave ovens and the like.

2. Description of the Prior Art

In general, magnetron apparatus of the forced air-cooled type, used in microwave ovens or similar devices, has a magnetron anode cylinder which is provided on the outer peripheral surface thereof with a multiplicity of heat radiating fins arranged in a plurality of stages, and cooling air is forced to flow through the gaps between adjacent heat radiating fins. The cooling air effectively cools the magnetron so as to suppress any tendency of temperature rise in the magnetron, thereby preventing unfavorable effects such as operation failure due to abnormal temperature rise or reduction in the coercive force of a permanent magnet due to temperature rise.

However, attaching a multiplicity of heat radiating fins to the outer peripheral surface of the magnetron anode cylinder requires troublesome work which makes it difficult to mass-produce the magnetron.

FIG. 1 exemplarily shows a typical known method for attaching the heat-radiating fins to the outer peripheral surface of the anode cylinder 1. According to this method, heat-radiating fins 2, 4 are successively attached to the outer peripheral surface of the magnetron anode cylinder 1 by, for example, pressfitting, such that cylindrical portion 5 of each horizontal fin fits around the cylindrical surface of the anode cylinder 1. This attaching method involves a risk in that the cylindrical portion 5 of the heat-radiating fin 4 is superposed to the cylindrically-deformed portion 3 of the preceding heat-radiating fin 2. This not only causes an irregularity in the gaps between adjacent heat-radiating fin but makes it impossible to obtain a large area of contact between the cylindrically-deformed portion 5 and the anode cylinder 1, thus impairing the heat-radiation effect significantly.

Another problem is that the anode cylinder 1, which is heated to a high temperature, cannot be effectively cooled by the air, because the flow E of the cooling air passing through the gap between adjacent heat-radiating fin 2, 4 is largely deflected to both lateral sides in the region near the magnetron anode cylinder 1 as shown in FIG. 2.

SUMMARY OF THE INVENTION

Accordingly, an object of the present invention is to provide a magnetron apparatus which is capable of overcoming the above-described problems of the prior art.

To this end, according to the present invention, there is provided a magnetron apparatus comprising a magnetron with an anode cylinder, and a radiator having an integral construction and attached to the outer peripheral surface of the anode cylinder so as to allow cooling air to pass therethrough, the radiator including a horizontal plate portion having a plurality of horizontal plates arranged in stages and each having a cylindrical portion for receiving the anode cylinder, and a pair of vertical walls which connect adjacent the horizontal plates, the vertical walls in the vertical wall portion serving to maintain, between adjacent horizontal plates, a gap which is equal to or greater than the axial length of the cylindrical portion.

With this arrangement, a plurality of the horizontal plates are integrated through the vertical plates so as to form an integral radiator. Therefore, the radiator can be handled and attached to the magnetron anode cylinder as a single unit. In addition, the vertical plates serve as spacers which maintain constant intervals between adjacent horizontal plates, so that the cylindrical portions of the horizontal plates can contact with the surface of the magnetron cylinder over their entire surfaces, thus ensuring a good heat-radiation effect. In addition, the vertical plates effectively serve as guide plates which effectively direct the flow of cooling gas towards the magnetron, thus contributing to the enhancement of the heat-radiation effect.

The above and other objects, features and advantages of the present invention will become clear from the following description of the preferred embodiments when the same is read in conjunction with the accompanying drawings.

DESCRIPTION OF THE PREFERRED EMBODIMENT

The invention will be explained in more detail through an embodiment which is shown in the accompanying drawings.

Figure 1:
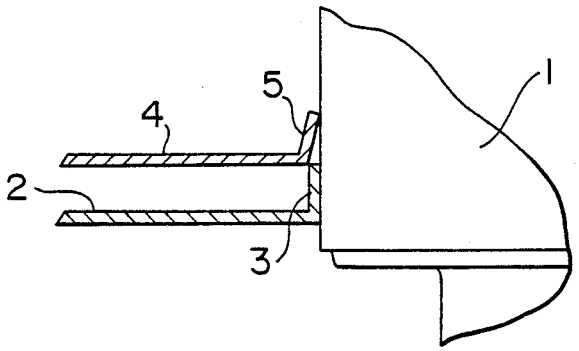
FIG. 1 PRIOR ART
FIG. 1 is a perspective view of a conventional magnetron apparatus, illustrating particularly the manner in which heat radiating plates are attached to a magnetron anode cylinder.
Figure 2:
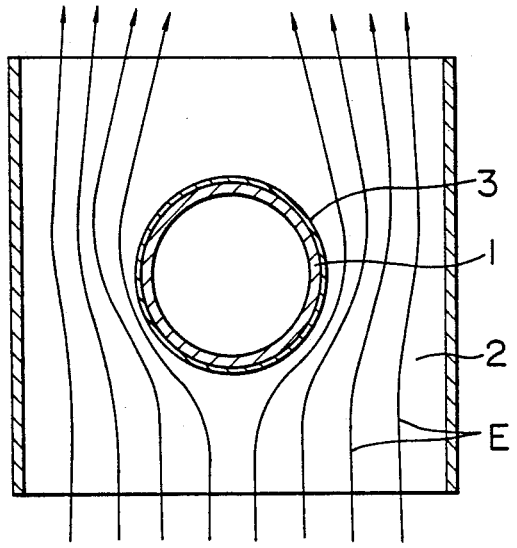
FIG. 2 PRIOR ART
FIG. 2 is a sectional plan view of the conventional magnetron apparatus showing particularly the flow of cooling air.
Figure 3:
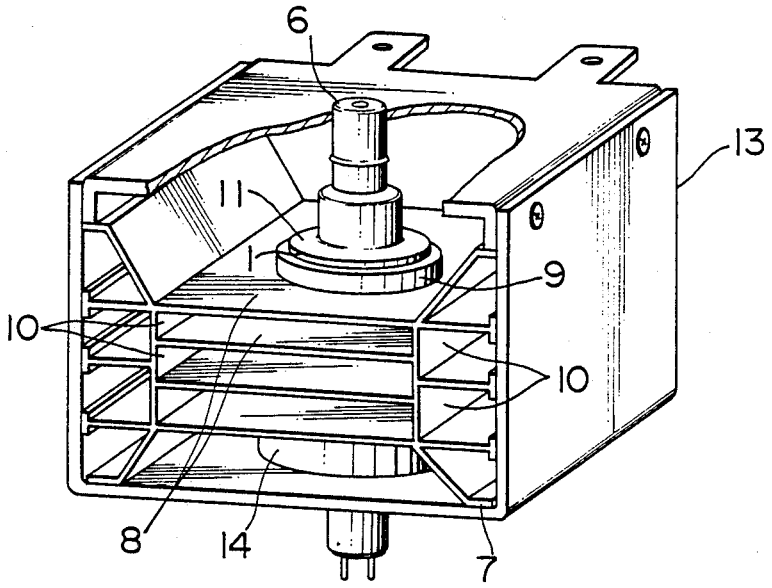
FIG. 3 is a fragmentary sectional view of a magnetron apparatus in accordance with the present invention.
Figure 5:
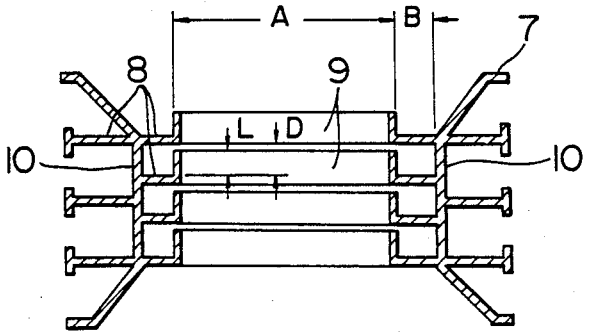
FIG. 5 is a sectional side elevational view of a heat radiator incorporated in the magnetron apparatus shown in FIG. 3.
Figure 4:
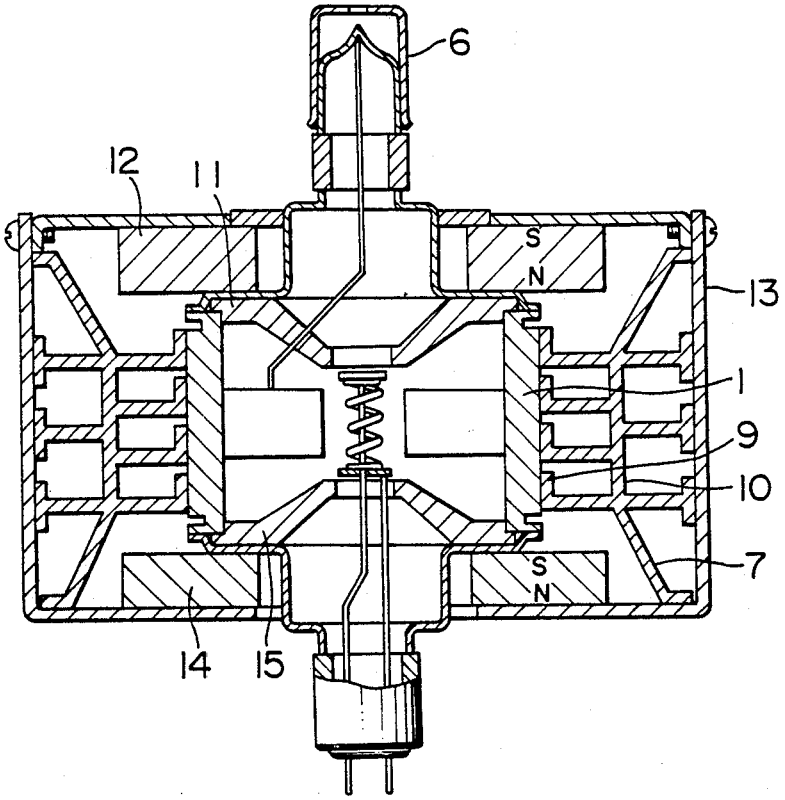
FIG. 4 is a sectional side elevational view of the magnetron apparatus shown in FIG. 3.

Referring to FIG. 3, a magnetron apparatus of the present invention has a magnetron 6 with an anode cylinder 1. The magnetron apparatus further has a radiator 7, attached to the outer peripheral surface of the anode cylinder 1, and made of aluminum or its alloy. The radiator 7 has a sectional shape as shown in FIGS. 4 and 5. As will be seen from these Figures, the radiator 7 has a plurality of horizontal plates 8 in a multiplicity of stages in such a manner that passages for cooling air are formed between adjacent horizontal plates 8. Each of the horizontal plates is provided with a cylindrical portion 9 for receiving the anode cylinder 1 of the magnetron 6. Adjacent horizontal plates 8 are connected to each other at their both ends remote from the anode cylinder 1 by means of a pair of vertical plates 10, 10. The distance D between the adjacent horizontal plates 8 is determined by the height of the vertical plates 10, 10. The distance D is determined to be substantially equal to or slightly greater than the axial length L of the cylindrical portion 9, i.e., such as to meet the condition of H≧L. The minimum distance A between the cylindrical portion 9 and the vertical plate 10 is comparatively small, e.g., 10 to 30% of the outside diameter B of the cylindrical portion 9.

The radiator 7 can be formed at a comparatively low cost by a process consisting of the steps of extruding a long blank, cutting the blank into sections of a predetermined length, and forming the cylindrical portion 9 by a press, and can be attached to the anode cylinder of the magnetron in such a manner that the cylindrical portions 9 of the horizontal plates 8 make close contact with the magnetron anode cylinder 1, without interfering with each other. An annular permanent magnet 12 is coaxially stacked on one magnetic pole 11 of the magnetron 6. The permanent magnet 12 has an outer magnetic pole S which is magnetically coupled to the outer magnetic pole N of another annular permanent magnet 14 through a frame-like or rectangular yoke 13. The inner magnetic pole S of the permanent magnet 14 is magnetically coupled to the other magnetic pole 15 of the magnetron 6.

Figure 6:
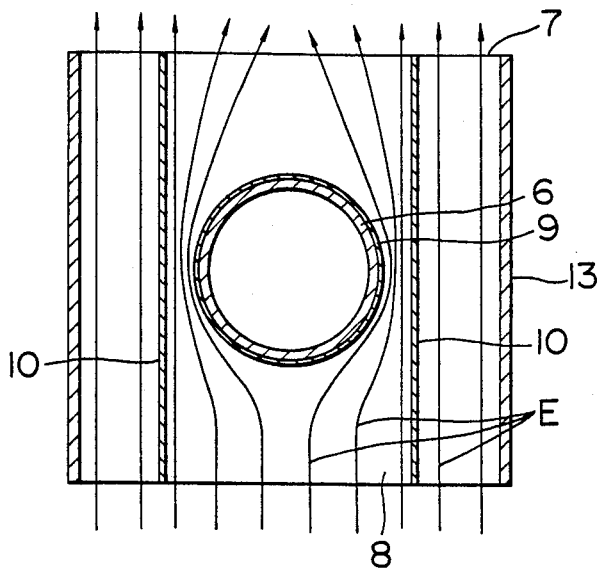
FIG. 6 is a sectional plan view of the magnetron apparatus shown in FIG. 3, illustrating particularly the flow of the cooling air.

In operation, cooling air is introduced into the cooling air passages formed between adjacent horizontal plates 8, 8 of the radiator 7, as indicated by arrows E (FIG. 6). The portion of the cooling air introduced into the space between both vertical plates 10, 10 are forcibly deflected to both lateral sides of the anode cylinder 1 of the magnetron 6, as it impinges upon the anode cylinder 1. According to the invention, however, the vertical plates 10, 10 serve as air guide plates which prevents the stream of air from spreading laterally, so that the air is forced to flow through the restricted areas between the outer surface of the anode cylinder and the adjacent vertical plates 10, 10 at a high density, and is then deflected inwardly at the downstream side of the anode cylinder 1. It is, therefore, possible to effectively cool the anode cylinder of the magnetron 6, as well as the portions of the radiator 7 around the anode cylinder 1. Meanwhile, the portion of the cooling air introduced into the gaps between the frame-like yoke and the adjacent vertical plates 10, 10 are guided to flow along the vertical plates 10 so that the portions of the radiator around these gaps are also cooled moderately. In addition, the presence of the vertical walls increases the heat-radiating surface area. For these reasons, it is possible to enhance the heat-radiating effect.

When the minimum distance B between the cylindrical portion 9 and each vertical plate 10 is reduced below 10% of the outside diameter A of the cylindrical portion 9, the flow of air passing through the channels between the anode cylinder 1 and the vertical plates 10, 10 encounters a large flow resistance, resulting in a reduction of the flow rate of cooling air coming into these channels. On the other hand, if the minimum distance A exceeds 30% of the outside diameter A, the aforementioned effect for preventing the lateral spreading of the cooling air is impaired.

Figure 7:
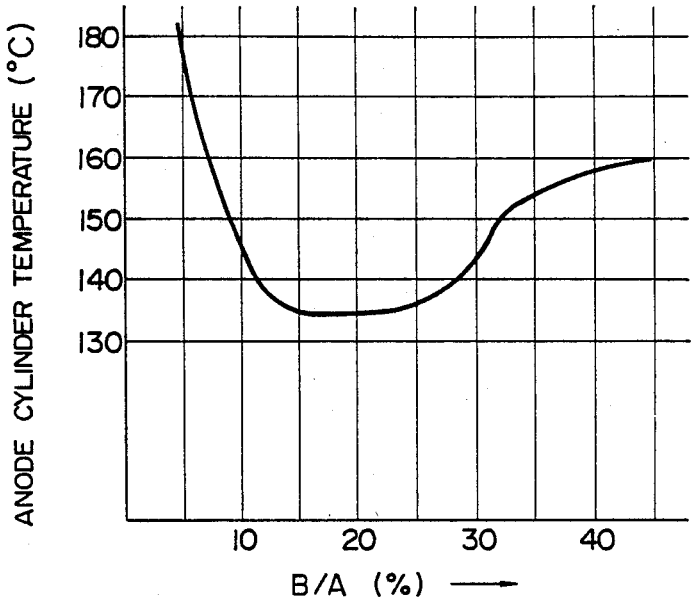
FIG. 7 is a graph showing the cooling characteristic of the magnetron apparatus of the present invention.

FIG. 7 illustrates the cooling characteristics of the magnetron apparatus, particularly the relationship between the ratio B/A and the temperature of the anode cylinder. From this Figure, it will be seen that the temperature of the anode cylinder can be decreased by 15° to 25° C. when the design is such that the ratio B/A ranges between 10 and 30%, e.g., when the outside diameter A of the cylindrical portion 9 is 4 to 12 mm while the distance B is 40 mm, as compared with the conventional arrangement in which the diameter A is about 25 mm. The greatest temperature drop of 25° C., i.e., the greatest improvement in the cooling effect, is obtained when the ratio B/A ranges between 15 and 25%.

As has been described, according to the invention, a plurality of horizontal plates are integrated through vertical plates so as to form an integral radiator. This radiator can be handled as a unit so that it can easily be attached to the anode cylinder of the magnetron. In addition, a regular interval is left between each adjacent horizontal plate, so that the cylindrical portions of the horizontal plates can be maintained in close contact with the anode cylinder, thus assuring a high cooling efficiency. Furthermore, this radiator can be produced at a comparatively low cost, through a simple process which employs extrusion and press work. In addition, the vertical plates effectively serve as air guide plates so as to optimize the pattern of flow of the cooling air.

What is claimed is:

1. A magnetron apparatus comprising a magnetron with an anode cylinder having an outer peripheral surface, a frame-like yoke having side walls, and a radiator attached to the outer peripheral surface of said anode cylinder and adapted to allow cooling air to pass therethrough, wherein said radiator includes a plurality of horizontal plates arranged in stages, each of said horizontal plates having a cylindrical portion for receiving therein said anode cylinder and outer side ends held in contact with the said side walls of said frame-like yoke, and a pair of vertical walls which connect between said each adjacent horizontal plates intermediate between said cylindrical portion and said outer side ends, said vertical walls serving to maintain, between said each adjacent horizontal plates, a gap which is greater than the axial length of said cylindrical portion of said each adjacent horizontal plates.

2. A magnetron apparatus according to claim 1, wherein said cylindrical portions of said horizontal plates are formed to extend in the same direction within the region between said vertical walls.

3. A magnetron apparatus according to claim 1, wherein the minimum distance between each vertical wall and said cylindrical portion ranges between 10 and 30% of the outside diameter of said cylindrical portion.

4. A magnetron apparatus according to claim 1, wherein said outer end portion of said horizontal plate of said radiator has a T-shaped sectional shape.

5. A magnetron apparatus according to claim 1, wherein said radiator has inclined plates which project from the points at which said horizontal plates and said vertical walls are connected to each other.

6. A magnetron apparatus according to claim 1, wherein said radiator has inclined plates which project from the points at which said horizontal plates and said vertical walls are connected to each other, the outer ends of said inclined plates being connected to yoke in a magnetic circuit for exciting said magnetron.

7. A magnetron apparatus comprising a magnetron with an anode cylinder having an outer peripheral surface, a rectangular yoke having side walls and corners at both upper and lower ends of said side walls, a radiator attached to the outer peripheral surface of said anode cylinder and adapted to allow cooling air to pass therethrough, and an external magnetic circuit for exciting said magnetron, wherein said radiator includes a plurality of horizontal plates arranged in stages, each of said horizontal plates having a cylindrical portion for receiving therein said anode cylinder and outer side ends held in contact with said side walls of said rectangular yoke, and a pair of vertical walls which connect between each said adjacent horizontal plates intermediate between said cylindrical portion and said outer side ends, said vertical walls serving to maintain, between said each adjacent horizontal plates, a gap which is greater than the axial length of said cylindrical portion, and inclined plates projecting from the portion where said horizontal plates and said vertical plates are connected to each other, said external magnetic circuit including at least one annular permanent magnet and the rectangular frame-like yoke, the outer ends of said inclined plates of said radiator being held in contact with the corners of said rectangular yoke.

8. A magnetron apparatus according to claim 7, wherein said cylindrical portions of said horizontal plates are formed to extend in the same direction within the region between said vertical walls.

9. A magnetron apparatus according to claim 7, wherein the minimum distance between each vertical wall and said cylindrical portion ranges between 10 and 30% of the outside diameter of said cylindrical portion.

* * * * *